United States Patent [19]

Canup

[11] 4,203,404

[45] May 20, 1980

[54] DISTRIBUTORLESS IGNITION METHOD AND SYSTEM FOR A MULTICYLINDER INTERNAL COMBUSTION ENGINE

[75] Inventor: Robert E. Canup, Poughkeepsie, N.Y.

[73] Assignee: Texaco Inc., White Plains, N.Y.

[21] Appl. No.: 885,844

[22] Filed: Mar. 13, 1978

[51] Int. Cl.[2] ..... F02P 1/00

[52] U.S. Cl. ..... 123/148 ND; 123/148 D

[58] Field of Search ..... 123/148 ND, 148 E, 148 CB, 123/148 D

[56] References Cited

U.S. PATENT DOCUMENTS

| | | | |
|---|---|---|---|
| 2,002,114 | 5/1935 | June | 123/148 ND |
| 2,866,839 | 12/1958 | Kaehni | 123/148 E |
| 2,960,973 | 11/1960 | Davis | 123/32 SA |
| 3,081,360 | 3/1963 | Kaehni | 123/148 E |
| 3,892,207 | 7/1975 | Weise | 123/32 SA |
| 3,900,015 | 8/1975 | Mainprize | 123/148 E |
| 3,910,246 | 10/1975 | Canup | 123/148 E |
| 3,910,247 | 10/1975 | Hartig | 123/148 E |
| 4,104,997 | 8/1978 | Padgitt | 123/117 R |

*Primary Examiner*—Ronald B. Cox
*Attorney, Agent, or Firm*—Carl G. Ries; Robert A. Kulason; Henry C. Dearborn

[57] ABSTRACT

An ignition system for internal combustion engines that operate with a combustible mixture in only one cylinder at a time. It eliminates the need for a distributor by firing all of the spark plugs simultaneously in accordance with the engine timing for each cylinder. It employs a transformer with a single low voltage primary and a plurality of high voltage secondary windings.

5 Claims, 3 Drawing Figures

DISTRIBUTORLESS IGNITION METHOD AND SYSTEM FOR A MULTICYLINDER INTERNAL COMBUSTION ENGINE

BACKGROUND OF THE INVENTION

1. Field of the Invention

This invention concerns ignition systems in general, and particularly ignition systems as applied to a fuel injection type of internal combustion engine. More specifically, it relates to an ignition system for a piston type of internal combustion engine as contrasted with a turbine type.

2. Description of Prior Art

While prior attempts have been made to eliminate the need for a distributor in an ignition system of the type employed by a piston type internal combustion engine, all known attempts have had various difficulties including the specialized nature of the elements employed, and the practicability of carrying out the concepts. For example, there is an old U.S. Pat. No. 1,335,933 to Bohli issued Apr. 6, 1920, which purports to eliminate the distributor, but which operates by separating the electrical paths of spark current by using rectifiers for this purpose. It employs only a single high voltage coil for generating the high potential needed to create the sparks at the spark plugs, and it appears doubtful that the desired effect for distributing the sparks would be obtainable.

Another prior attempt was suggested by a patent to June U.S. Pat. No. 2,002,114 issued May 21, 1935. That patent makes use of special spark plugs with a single electrode so that the other electrode for spark generation becomes the piston as the engine is operated. The system generates sparks at two of the cylinders simultaneously, one of which is on the compression stroke while the other is on the exhaust stroke. However, the other two cylinders have a large distance between the spark plug electrodes and the pistons, so that no sparks are created there. Again in this case, there is only a single vibrator coil which supplies the high voltage potential to the spark plugs.

Another attempt was suggested by the Patent to Grow U.S. Pat. No. 2,324,923 issued July 20, 1943. This patent employs specially constructed spark plugs and uses solenoids to move one of the electrodes for creating a spark gap at the time when a spark is desired at that cylinder.

Also, there are two patents to Short U.S. Pat. Nos. 2,436,905 issued Mar. 2, 1948 and 2,456,743 issued Dec. 21, 1948. The approach used in these patents is to provide individual tuned circuits at the spark plugs while connecting an oscillator output to them all with a variation in the frequency of the oscillator. Thus, each spark is generated when the oscillator frequency matches that of the tuned circuit at a particular spark plug.

In contrast to the aforementioned attempts to eliminate a distributor, the applicant has as an object of the invention the provision of a system for generating sparks simultaneously at all of the spark plugs of a piston type internal combustion engine. The engine, of course, must be a type that has a combustible mixture in only one cylinder at a time.

SUMMARY OF THE INVENTION

Briefly, the invention concerns a distributorless ignition system for use on a multi-cylinder internal combustion engine of a type that has a combustible mixture in only one cylinder at a time. Each of said cylinders has a spark plug for ingniting a fuel mixture therein, and the system comprises a high voltage electrical system which in turn comprises a transformer having a low voltage primary winding. The system also comprises a plurality of high voltage secondary windings on said transformer; and circuit means for connecting said spark plugs into said secondary winding circuits, without switching, for developing sparks at all of said spark plugs simultaneously.

Again briefly, the invention concerns a distributorless ignition system for use on a multi-cylinder internal combustion engine, having at least four cylinders and being a type that has a combustible mixture in only one cylinder at a time. Each of said cylinders has a spark plug for igniting a fuel mixture therein, and said spark plugs have an insulated electrode and a grounded electrode. The system comprises a transformer having a low voltage primary winding, and at least two high voltage secondary windings one for each of a pair of said spark plugs. It also comprises circuit means for directly connecting the ends of said secondary windings to any two of said insulated electrodes without a distrubutor, for producing simultaneous sparks at all of said spark plugs.

Again briefly, the invention concerns a method for developing electrical ignition sparks at the spark plugs of an internal combustion engine of a type having multi-cylinders and having a combustible fuel mixture in only one cylinder at a time. The method comprises generating said ignition sparks simultaneously at all of said spark plugs, and timing said sparks in accordance with the operation of said engine.

Once more briefly, the invention is in conjunction with a multi-cylinder internal combustion engine having electric spark type ignition of said internal combustion in said cylinders. The cylinders each have a spark plug mounted therein and said engine is a type that operates with a combustible fuel mixture in only cylinder at a time. The invention concerns a method of eliminating a disturbutor for said ignition sparks; and it comprises steps for generating simultaneously sparks at all of said spark plugs, each time said one cylinder at a time is to be ignited. The said steps comprise providing a transformer having high leakage inductance coupling between a low voltage primary and a plurality of high voltage secondary windings. It also comprises connecting at least one of said spark plugs to each of said secondary windings, and providing a control signal from each of said cylinders for controlling current flow in said low voltage primary winding to time the said generation of simultaneous sparks.

And finally in brief, the invention relates to an ignition system for a multi-cylinder internal combustion engine having an engine-block of electrically conductive material and operating with a combustible mixture in only one cylinder at a time. The said cylinders each have a spark plug for igniting said mixture, and said spark plugs each have an insulated and an uninsulated electrode forming a spark gap therebetween. The said system comprises a transformer having a low voltage primary winding and a number of high voltage secondary windings equal to half the number of cylinders in said engine. The said secondary windings each have an independent magnetic path and all said paths are common to said primary winding. It also comprises means for controlling current flow in said primary winding in accordance with engine timed conditions related to said cylinders, and circuit means including said engine block for directly connecting two of said spark plugs to each of said secondary windings for developing sparks at all of said gaps simultaneously as determined by primary winding current control means.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENTS

Figures 1, 2, 3:
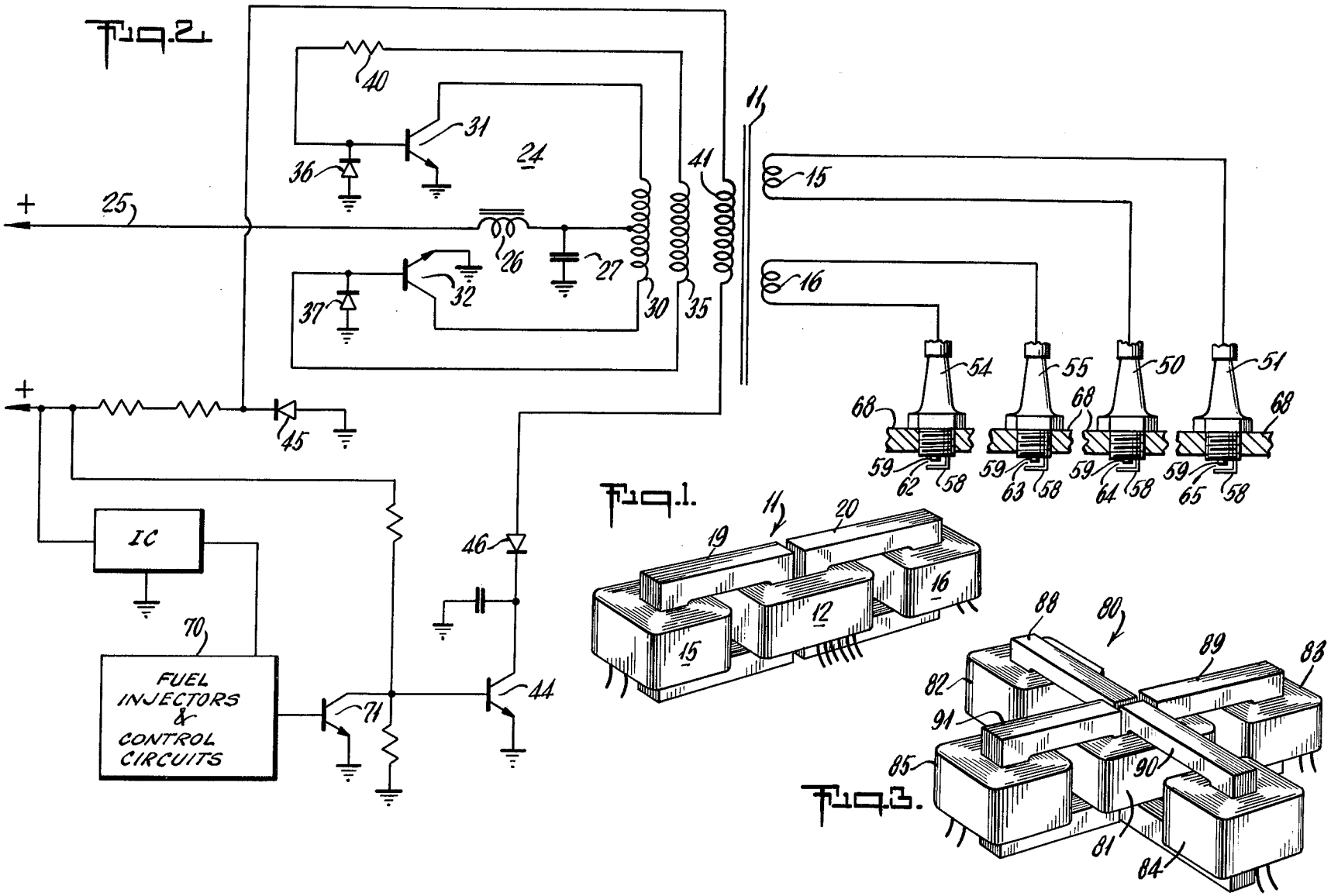
FIG. 1 is a schematic illustration of a transformer in accordance with the invention.
FIG. 2 is a schematic electrical circuit diagram illustrating an ignition system according to the invention.
FIG. 3 is another schematic illustration of a modification of a transformer according to the invention.

This invention is particularly applicable to an AC ignition system of the type generally described and illustrated in a prior U.S. Pat. No. 3,910,246 issued Oct. 7, 1975. However, the principles would not change if the invention were applied to a more conventional, one shot type of spark generating system, e.g. a capacitor discharge type, or the conventional inductance type spark generated by the mere breakerpoint disconnection of a low voltage primary winding circuit in the coil. Basically, the concept of this invention relates to the use of a plurality of secondary high voltage spark signal output windings, in connection with the generation of ignition sparks.

In connection with the use of an AC type spark generating system like that illustrated in the aforementioned U.S. Pat. No. 3,910,246, it has been discovered that by having the output transformer designed for loose coupling between the primary and a plurality of secondary coils (i.e. with high leakage inductances) the current which flows through a spark plug gap when it arcs over will be limited to a safe value. Consequently, the generation of more than one spark simultaneously is quite feasible. The leakage inductance desired may be provided by allowing some of the magnetic lines of flux which cut the transformer primary, to by-pass the secondary winding or windings. This limits the amount of secondary current but has no effect on the total member of flux linkages cutting the primary winding. Thus, a transformer may be constructed in the manner illustrated by FIGS. 1 or 3. In FIG. 1 there is a transformer 11 which has a primary low voltage winding 12 that is coupled magnetically with a pair of high voltage secondary windings 15 and 16. There are independent separate magnetic paths formed by soft iron cores 19 and 20 that each have one leg which together make a common magnetic path in relation to the primary winding 12.

FIG. 2 illustrates an ignition system like the one indicated above, i.e. an AC system for generating spark voltages. While the electronic and electrical system decribed is well known from earlier patents (including the one indicated above i.e. U.S. Pat. No. 3,910,246), such a system will be briefly described here in connection with FIG. 2. It is basically an AC system which includes a high voltage output transformer 11 that may take the form indicated by the FIG. 1 illustration. Transformer 11 is electrically driven by a transistor "flip-flop" oscillator 24 which has a DC power connection via a connector 25 and a choke coil 26. There is also a capacitor 27 that is connected to the power connection, and is grounded. This is to eliminate any AC from the oscillator 24 going back to the power source, e.g. a battery or the like. The D.C. power is applied to a center tap on a low voltage primary winding 30 that has the ends thereof connected to a pair of transistors 31 and 32 via the collector electrodes of each. The emmitters of these transistors are grounded, as indicated. And, the base electrodes are connected to the ends of a feed back winding 35. There are diodes 36 and 37 connected to the base electrodes of transistors 31 and 32 which act to prevent harmful reverse voltages from damaging the transistors. Such reverse voltages would develop across the emitter-to-base circuits thereof. Also, there is a resistor 40 in the feed back circuit which partially determines the frequency of the oscillation.

There is a control winding 41 which acts to control starting and stoping the oscillator 24 whenever a spark signal output voltage is called for. There is a transistor 44 that acts as an electronic switch. It is in series with the control winding 41 and a source of small DC current which biases the core of transformer 11 so as to provide instant starting of the oscillator 24 when the transistor switch 44 is opened, i.e. the transistor 44 is non-conducting. When transistor 44 is conducting (i.e. the transistor switch action is closed) the oscillator 24 is loaded down and maintained non-oscillating by reason of an AC short circuit. Such short circuit includes a diode 45 and another diode 46 both in series with the transistor switch 44 and the control winding 41. The action of this system has been adequately described heretofore in a number of patents of which I am sole or joint inventor. These include the aforementioned U.S. Pat. No. 3,910,246 which makes reference to others.

Of particular note here is the fact that low voltage primary winding 30 of the transformer 11 is included in the coil package 12 that is illustrated in FIG. 1. It is the AC current flow in this primary winding 30 that generates high voltage spark voltages in the secondary windings 15 and 16 illustrated. When the elements are connected as indicated in FIG. 2, there is a pair of spark plugs 50 and 51 that are connected to the ends of the high voltage secondary winding 15. Similarly, there is another pair of spark plugs 54 and 55 that are connected to the ends of the other high voltage winding 16. The spark plugs each have a grounded electrode 58 and an insulated electrode 59 with a spark gap as indicated therebetween. Thus, there are four spark gaps 62, 63, 64 and 65 which are each located in an individual one of four cylinders (not shown) of an internal combustion engine. The engine is a type that has a combustible mixture of fuel in only one of the cylinders at a time. It will be appreciated that the engine has a single block 68 which is constructed of an electrically conductive material. Consequently, a circuit is completed between all of the grounded electrodes 58 of the spark plugs, in common. Consequently, each high voltage secondary winding 15 and 16 has a circuit that is completed across two spark gaps 64, 65 and 62, 63 respectively, in series.

Normally, in a four cylinder engine the spark plugs are fired once for every two revolutions of the crank shaft. However, in the type of engine involved here, the timing is related to the fuel injection and only indirectly to the crank shaft revolutions.

It will be observed that the control of the electronic switch, i.e. transistor 44, is in accordance with engine timed conditions. It includes signals developed at the fuel injectors in the type of engine under consideration. This is indicated by a box 70 which carries the caption "Fuel Injectors and Control Circuits".

Signals from each of the fuel injectors control a transistor 71 that has its output in the base circuit of the electronic switch transistor 44. It will be understood that as each fuel injector is actuated, a combustible fuel mixture is injected into each such cylinder, one at a time. Also, a timing signal is developed which acts upon the output transistor 71 to control the electronic switch transistor 44. The latter develops a spark signal at the transformer 11 as indicated above. It may be noted that as each fuel injection takes place the spark signal is created at all of the spark plugs simultaneously even though only the one where the fuel has been injected will be effective to cause the combustion in that cylinder.

The development of timing signals in the foregoing manner, i.e. in conjunction with the fuel injection valve action, has been indicated in an earlier U.S. Pat. No. 4,066,059.

It may be noted that, as illustrated in FIG. 3, the transformer may have additional secondary windings with individual independent magnetic paths for each. Thus, in FIG. 3 there is a transformer 80 that has a low voltage primary winding in a coil 81. Coil 81 has magnetically coupled thereto four high voltage secondary winding coils 82, 83, 84 and 85. Each of these secondary coils have individual independent magnetic paths through cores 88, 89, 90 and 91 respectively which all join in a common magnetic path through the coil 81 that has the low voltage primary winding therein.

It may be noted that a transformer arrangement like that illustrated in FIG. 3 might be used to connect each of the secondary coils to a single spark plug, if desired. However, preferrably this arrangement would be employed to connect two spark plugs in series with each coil, so that it would be used on an eight cylinder engine. It may also be noted that the transformer structure might be arranged with three secondary coils and cores. The latter would be particularly adaptable for use with a six cylinder engine.

It is to be noted that a method in accordance with the invention might make use of various and different apparatus for carrying it out. The method is one for developing electric ignition sparks at the spark plugs at an internal combustion engine. The engine being of a type having multi-cylinders and having a combustible fuel mixture in only one cylinder at a time. The method includes a step of generating the ignition sparks simultaneously at all of the spark plugs in the engine. It will be observed from the foregoing that this may be done with a system (as illustrated in FIG. 2) where the generation of ignition sparks is carried out through the two secondary windings 15 and 16. These have the necessary high voltages induced therein to cause sparking at all four of the gaps 62, 63, 64 and 65 simultaneously.

The method includes, of course, timing of the sparks being generated in accordance with the operation of the engine. As indicated above, such timing is developed in a system like that indicated in the illustration of FIG. 2, by having signals generated at the fuel injector during the operation of the engine.

The invention may also be described as a method of eliminating a distributor for an internal combustion engine. Such method is employed in conjunction with a multi-cylinder internal combustion engine having electric spark type ignition for the internal combustion in the cylinders of such engine. The cylinders each have a spark plug mounted therein and the engine is of a type that operates with a combustible fuel mixture in only one of the cylinders at a time. The method comprises steps that are involved in generating simultaneous sparks at all of the spark plugs, each time one cylinder is to be ignited. The steps include providing a transformer that has high leakage inductance coupling between a low voltage primary winding and a plurality of high voltage secondary windings. This step is indicated by the transformer illustration of FIGS. 1 and 3.

Another step is connecting at least one of the spark plugs to each of the secondary windings. This step involves the electrical connections such as those that are indicated in the circuit shown in FIG. 2.

Finally, there is a step of providing a control signal from each of the cylinders for controlling current flow in the low voltage primary winding, in order to time the generation of simultaneous sparks. This step is indicated in FIG. 2 by the diagramatic block carrying reference no. 70. Particular details of such signal development are clearly not necessary, so long as it is understood that whenever one of these signals develops at any of the cylinders (as the fuel injection takes place), the resulting control will act upon the low voltage primary winding (winding 30) so as to generate the necessary high voltage spark signals in the secondary windings 15 and 16. Of course, the control of the current in primary winding 30 comes from the conditions in control winding 41 in the ignition system of FIG. 2.

It will be understood that the principles of the invention are applicable to other types of ignition systems. For example, a capacitor discharge type system or an inductance coil type system or the like, where a single shot rapidly decaying type spark signal is generated each time. Such systems would employ plural high voltage secondary windings and generate simultaneous spark voltages therein.

While particular embodiments of the invention have been described above in considerable detail in accordance with the applicable statutes, this is not to be taken as in any way limiting the invention but merely as being descriptive thereof.

I claim:

1. An ignition system for a multi-cylinder internal combustion engine which operates with a combustible mixture in only one cylinder at a time, said cylinders each having a spark plug for igniting said mixture, said system comprising a transformer having a low voltage primary winding and a plurality of high voltage secondary windings, said secondary windings each having an independent magnetic path coupling it to said primary winding, means for controlling current flow in said primary winding in accordance with engine timed conditions related to said cylinders, and circuit means for directly connecting at least one of said spark plugs to each of said secondary windings for developing simultaneous sparks at all of said spark plugs as determined by said primary winding current control means.

2. An ignition system according to claim 1, wherein said transformer has an equal number of said secondary windings as the number of cylinders in said engine.

3. An ignition system according to claim 1, wherein said circuit means connects two of said spark plugs to each of said secondary windings and includes the block of said engine therein.

4. An ignition system according to claim 1, wherein said secondary winding independent magnetic paths are common to said primary winding.

5. An ignition system for a multi-cylinder internal combustion engine having an electrically conductive material block and operating with a combustible mixture in only one cylinder at a time, said cylinders each having a spark plug for igniting said mixture, said spark plugs each having an insulated and an uninsulated elelctrode forming a spark gap therebetween, said system comprising a transformer having a low voltage primary winding and number of high voltage secondary windings equal to half the number of cylinders in said engine, said secondary windings each having an independent magnetic path and all said paths being common to said primary winding, means for controlling current flow in said primary winding in accordance with engine timed conditions related to said cylinders, and circuit means including said engine block for directly connecting two of said spark plugs to each of said secondary windings for developing sparks at all of said gaps simultaneously as determined by said primary winding current control means.

* * * * *